United States Patent [19]

Buchser et al.

[11] 4,288,135

[45] Sep. 8, 1981

[54] FRENCH DOOR REFRIGERATOR SEAL

[75] Inventors: William J. Buchser, Marrs Township, Posey County; Ralph Tate; Charles W. Haag, both of Center Township, Vanderburgh County, all of Ind.

[73] Assignee: Whirlpool Corporation, Benton Harbor, Mich.

[21] Appl. No.: 83,974

[22] Filed: Oct. 11, 1979

[51] Int. Cl.[3] ..... E06B 7/16; A47B 96/00

[52] U.S. Cl. ..... 312/296; 312/214; 49/368; 49/483; 49/484

[58] Field of Search ..... 312/296, 214; 49/366, 49/367, 368, 483, 484

[56] References Cited

U.S. PATENT DOCUMENTS

| | | | |
|---|---|---|---|
| 2,441,080 | 5/1948 | Peglow | 62/89 |
| 2,449,384 | 9/1948 | Hursey et al. | 62/89 |
| 2,811,406 | 10/1957 | Moore et al. | 49/483 |
| 3,070,852 | 1/1963 | Hilliker | 312/296 |
| 3,161,925 | 12/1964 | Bertolini | 49/368 |
| 3,248,159 | 4/1966 | Hall | 312/296 |
| 3,259,446 | 7/1966 | Harle et al. | 312/296 |
| 3,264,048 | 8/1966 | Koch et al. | 312/296 |
| 3,382,618 | 5/1968 | Townsend | 49/483 |
| 3,408,772 | 11/1968 | Frehse | 312/296 |
| 3,432,966 | 3/1969 | Bordner | 49/483 |
| 3,466,804 | 9/1969 | Swaneck, Jr. | 49/483 |
| 3,942,853 | 3/1976 | Grimm et al. | 312/296 |
| 4,185,416 | 1/1980 | Wilmes | 49/483 |

FOREIGN PATENT DOCUMENTS

| | | | |
|---|---|---|---|
| 1342662 | 9/1963 | France | 49/483 |
| 366659 | 2/1963 | Switzerland | 49/483 |

*Primary Examiner*—Victor N. Sakran

*Attorney, Agent, or Firm*—Wegner, Stellman, McCord, Wood & Dalton

[57] ABSTRACT

A french door refrigerator seal having vertically extending seal elements on the juxtaposed edges of the french doors defining an air space therebetween. Closure seals are provided at the upper and lower ends of the edge seals to close the air space and thereby define an insulative dead air space between the french door edge portions when the doors are in the closed position. The closure seals illustratively may be formed as overlapping flexible flaps carried by the vertical edge seal elements which illustratively may form pairs of flexible flaps.

24 Claims, 5 Drawing Figures

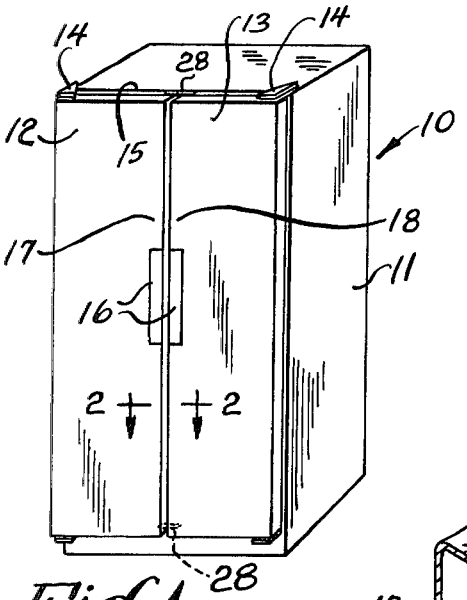
Fig. 1
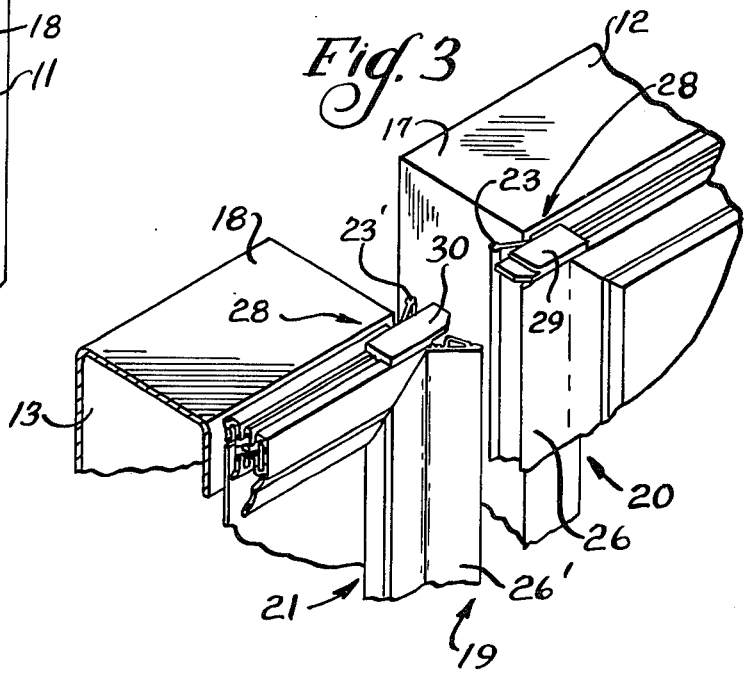
Fig. 3
Fig. 2
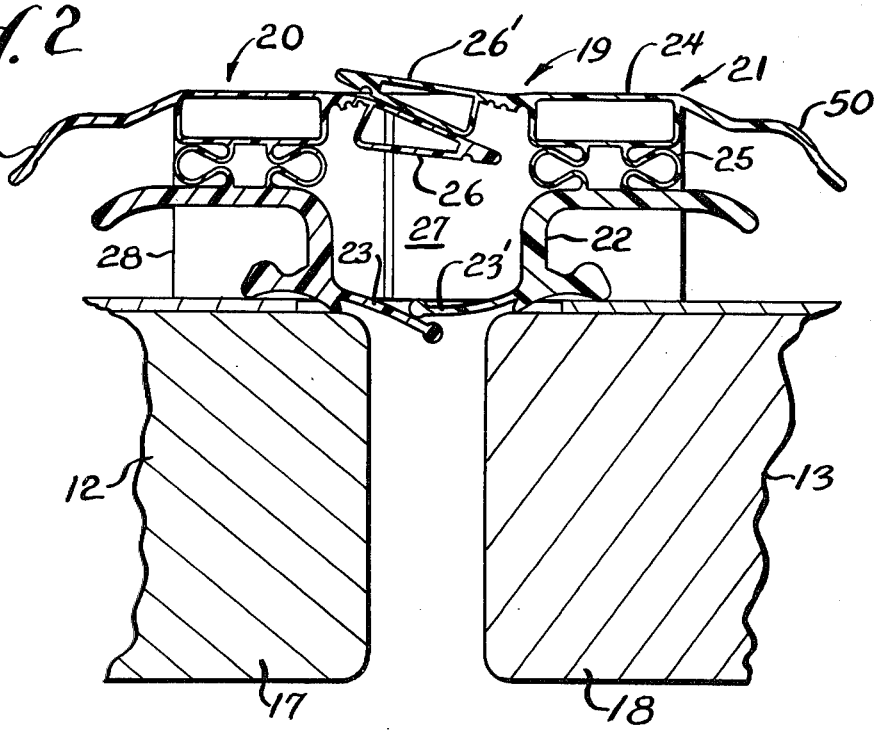

FRENCH DOOR REFRIGERATOR SEAL

BACKGROUND OF THE INVENTION

1. Technical Field

This invention relates to refrigerator door seals and in particular to seals for sealing french-type refrigerator doors wherein juxtaposed edges of the french doors extend across the access opening of the refrigerated space.

2. Background Art

In one improved form of french door refrigerator construction disclosed in co-pending U.S. Patent application Ser. No. 38,574, of Charles W. Haag, which application is owned by the assignee hereof, an improved double seal structure is provided formed of two pairs of overlapping seal flaps defining an air space therebetween. The present invention defines a further improvement over the structure of said application in effectively causing the air space to comprise a dead air, thermally insulating space.

Additional background art disclosures are found in U.S. Letters Patent, such as that of Walter Peglow, U.S. Pat. No. 2,441,080, which shows a refrigerator cabinet having a french door closure portion. Peglow teaches the provision of a vertical channel between the juxtaposed door edges through which is flowed warm air from the machinery compartment, thereby to prevent condensation of moisture on the outer surface of the cabinet about the access opening.

Willis E. Hursey et al show, in U.S. Pat. No. 2,449,384, a french door refrigerator having a center mullion. Hursey et al provide an extension of the mullion which projects outwardly between the french doors so as to be disposed in the path of circulating air to prevent formation of condensation thereon.

Charles E. Hall, in U.S. Pat. No. 3,248,159, shows a french door construction wherein magnetic gasket portions seal against each other when the french doors are in the closed position.

In U.S. Pat. No. 3,264,048, Alan J. Koch et al show a refrigerator door seal wherein the magnetic gaskets between the french doors thereof define overlapping flaps permitting the seal to be made irrespective of which door is closed first.

Russell S. Townsend, in U.S. Pat. No. 3,382,618, shows a closure sealing means wherein a partial enclosed air space is formed by a first pair of flaps which overlap in the closed position of the doors and a second pair of flaps which, while juxtaposed, remain spaced from each other in the closed position of the french doors.

Walter C. Frehse shows, in U.S. Pat. No. 3,408,772, a gasket arrangement having overlapping magnetic flaps wherein the french doors are arranged to close against a center mullion. The gasket provides a seal between the doors and holds one door in the closed position when the other door is opened independently thereof.

Bernard J. Grimm et al, in U.S. Pat. No. 3,942,853, show a gasket assembly having pairs of gasket elements extending along the french door juxtaposed edges forming vertically extending insulating chambers. Flanges on the gasket assembly extend into contact with the center mullion, when present, or into contact with each other when the mullion is not present. The insulating chambers, as disclosed, extend from end to end of the seals, with no means for closing the end of a chamber defined between the gasket elements being taught or suggested.

SUMMARY OF THE INVENTION

The present invention comprehends an improved means for sealing the juxtaposed edges of a refrigerator french door closure wherein means are provided for closing the ends of an air space defined by seal elements carried respectively on the juxtaposed door edge portions forwardly of the refrigerated space, thereby effectively defining a closed dead air space providing an improved thermally insulating seal between the closed doors.

The seal may be defined by two pairs of sealing flaps mounted respectively to the juxtaposed french door edge portions, and end flaps closing the upper and lower ends of the air space defined by the vertically extending sealing flaps when the doors are in the closed disposition.

The end flaps may be mounted to the vertically extending sealing flaps.

In the illustrated embodiment, the end flaps are formed of a flexible material which may be similar to the materials of which the vertically extending sealing flaps are formed.

The end flaps may abut in the closed disposition and, in the illustrated embodiment, the end flaps overlap each other in the closed disposition.

The gasket assembly defining the sealed dead air space is located forwardly of the cabinet front flange in the closed disposition of the doors, with the sealing means extending substantially the full height of the doors whereby the upper and lower ends thereof also define portions of the sealing structure disposed forwardly of the cabinet front surface.

In one embodiment, the end flaps define the uppermost and lowermost portions of the sealing structure.

The end flaps may be secured to the vertical seal elements by conventional securing steps.

As the gasket assembly is disposed forwardly of the cabinet, the sealing structure is adapted for sealing the doors independently of any center mullion structure of the apparatus. The seal, however, is equally effective where the refrigerator cabinet is provided with a center mullion. The improved outer dead air space seal effectively prevents condensation on the exterior portions of the seal surfaces.

The invention further comprehends a further embodiment wherein the dual gasket dead air space seal is provided in combination with a third pair of closure seal elements to provide a triple gasket seal for further improved thermally insulating closure of the refrigerated cabinet by the french doors.

In the triple seal arrangement, the innermost sealing flaps are disposed within the refrigerated cabinet and define a dead air space which is closed at the top and bottom by the top and bottom walls of the refrigerator cabinet between which they vertically extend.

The outer gasket assembly may be mounted to the refrigerated cabinet by a suitable bracket which may include an innermost portion mounting the innermost gasket assembly also to the cabinet.

Thus, in the modified form of the invention, a pair of dead air spaces is provided between the french doors when they are placed in the closed disposition. One of the dead air spaces is disposed externally of the cabinet and is provided with its own means for closing the top and bottom of the dead air space. The other of the dead air spaces is disposed within the cabinet and utilizes portions of the cabinet to close the top and bottom thereof.

The refrigerator door seal constructions of the present invention are extremely simple and economical of manufacture while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view of a refrigeration apparatus having an improved french door sealing structure embodying the invention;

FIG. 2 is a fragmentary enlarged horizontal section taken substantially along the line 2—2 of FIG. 1;

FIG. 3 is a fragmentary outwardly looking perspective view of the sealing structure as mounted on the refrigerator doors;

DESCRIPTION OF THE PREFERRED EMBODIMENT

Figure 4:
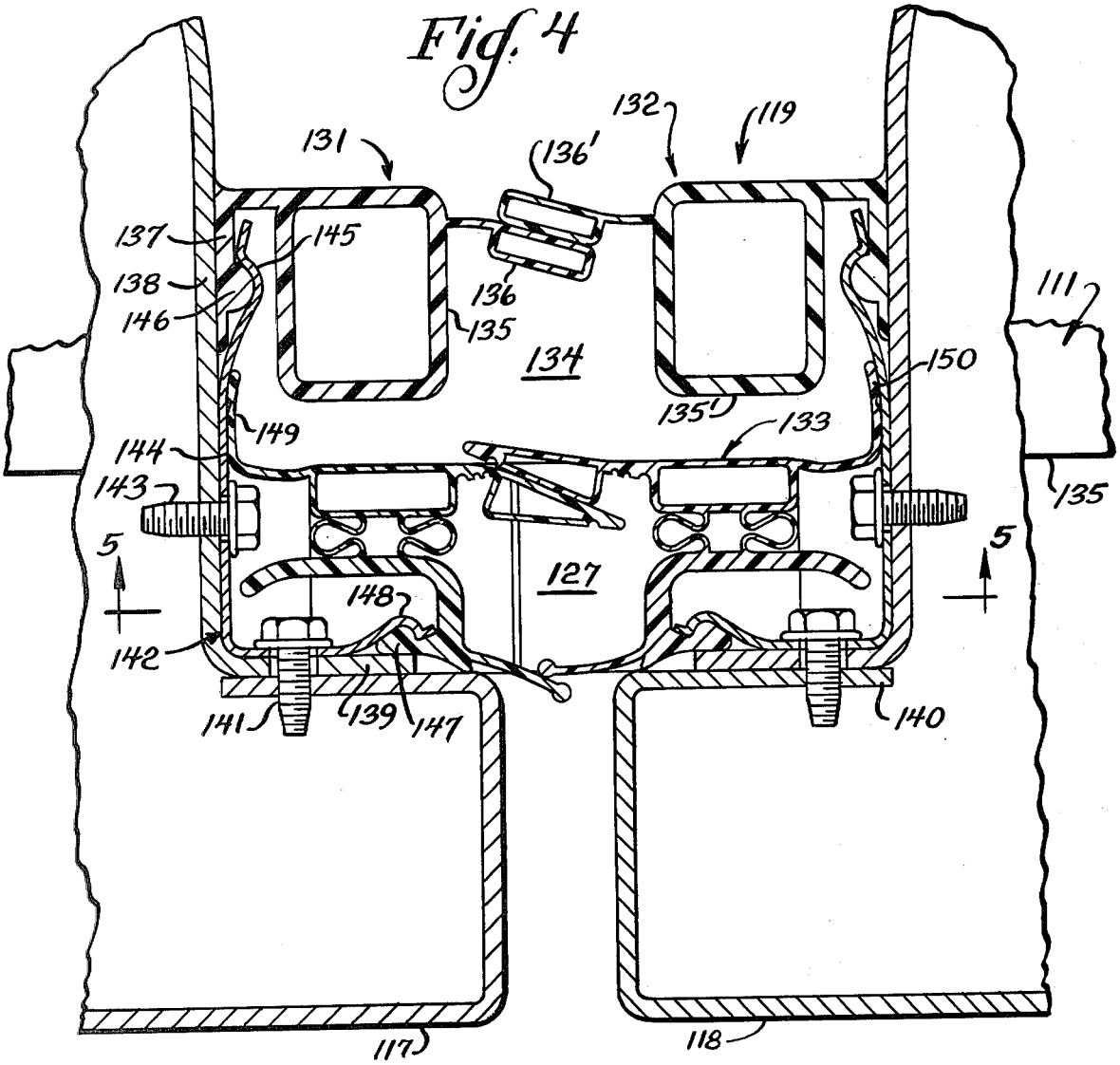
FIG. 4 is a fragmentary enlarged horizontal section of a modified form of sealing structure embodying the invention.

In the exemplary embodiment of the invention as disclosed in FIGS. 1-3 of the drawing, a refrigeration apparatus generally designated 10 is shown to comprise a cabinet 11 provided with a pair of french doors 12 and 13 pivotally mounted to the cabinet by suitable pivots 14. The doors are disposed in a closed disposition, as shown in FIG. 1, across the front of the cabinet forwardly of a front flange portion 15 thereof. The doors are provided with handles 16 for permitting the selective movement of either or both of the doors from the closed position for facilitated access to the interior of cabinet 11 when desired.

A problem arises in the use of such french doors in connection with refrigeration apparatuses in that it is desirable to seal the two doors at their juxtaposed end portions 17 and 18 when the doors are in the closed position. As indicated briefly above, an improved seal for such french doors in a refrigeration apparatus is disclosed in co-pending application Ser. No. 38,574, of Charles W. Haag.

The present invention comprehends a further improved seal structure for such use having novel means for closing the ends of the dead air space defined by the seal structure.

More specifically, as seen in FIGS. 2 and 3, the seal structure generally designated 19 comprises a pair of complementary seals 20 and 21, carried respectively, on the door portions 17 and 18. Each seal includes an outer mounting portion 22 carried by the door edge portion and provided with a flexible outer sealing element 23, which overlaps with the corresponding outer sealing element of the opposite dual seal, as shown in FIG. 2. Each seal further includes an inner mounting portion 24 connected to mounting portion 22 by a flexible accordion portion 25. The inner mounting portion is provided with a flexible sealing portion 26 which overlaps with the corresponding sealing portion of the other seal, as shown in FIG. 2.

In the illustrated embodiment, the mating sealing portions are identified as 23' and 26', respectively. As shown in FIG. 2, when doors 12 and 13 are in the closed disposition, the sealing portions 23, 23' and 26, 26' overlap in sealed engagement with each other so as to define a dead air space 27, which extends vertically the length of the doors forwardly of the front flange 15 defining the front opening of the refrigerator cabinet 11.

As shown in FIG. 3, the invention comprehends the provision of closure means generally designated 28 for closing the ends of the air space 27 to effectively define a dead air, thermally insulating space between doors 12 and 13, and more specifically, between edge portions 17 and 18 thereof.

As shown in FIG. 3, the closure means 28 comprises a pair of end flaps 29 and 30 carried on the dual seals 20 and 21, respectively. The end caps 29 and 30 are preferably formed of a flexible material, and in the illustrated embodiment, are formed of a material similar to that of which the dual seals 20 and 21 are formed. The end caps are arranged to overlap in the closed position of the doors so as to effectively define a sealing closure one each at the top and bottom of the air space 27.

The end caps are secured to the dual seal gasket structures by suitable securing means, such as solvent bonding, adhesive bonding, sonic welding, etc. The end caps extend generally horizontally and are sufficiently flexible so as to not interfere with the proper closing and sealing of the doors.

The end caps are disposed forwardly of the cabinet flange 15 and, thus, provide an insulated dead air space between the doors outwardly of the cabinet for improved thermal efficiency in the operation of the refrigeration apparatus 10.

As will be obvious to those skilled in the art, the end caps may comprise compressible materials which may be brought into abutting relationship in effecting the desired seal at the top and bottom of the air space 27. The invention comprehends that the end caps 29 and 30 thus may be formed of compressible flexible material so as to provide either abutting or overlapping engagement, or a combination of abutment and overlapping relationship as desired.

Figure 5:
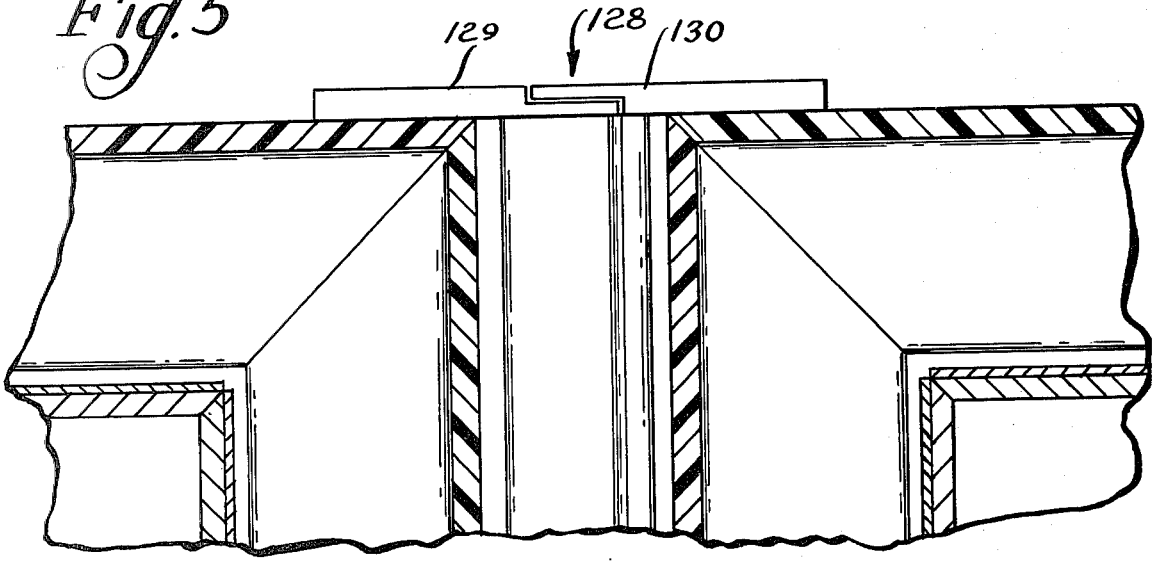
FIG. 5 is a fragmentary vertical section taken substantially along the line 5—5 of FIG. 4.

Referring now to the embodiment of the invention as disclosed in FIGS. 4 and 5 of the drawing, an improved triple seal structure generally designated 119 is shown to comprise a seal structure generally similar to seal structure 19 but further including inner seals 131 and 132 cooperatively defining, with the outer seal structure generally designated 133, an inner dead air space 134 which is received inwardly of the front flange 135 of the cabinet 111.

As shown in FIG. 4, the seals 131 and 132 are reversely similar. Seal 131 includes a mounting portion 135 carrying a distal sealing element 136 which sealingly engages a mating sealing element 136' carried on a mounting portion 135' of seal 132.

Seal 131 includes a mounting portion 137 which is facially engaged with an inturned wall 138 mounted to the door 117 by a suitable securing means, such as screws 141. Screws 141 further secure to the wall 138 a mounting clip 142 which is urged against a turned leg 139 on the wall 138 by the screws 141. Additional screws 143 may be provided for securing a rearwardly extending portion 144 of the clip 142 to the inturned wall 138.

As shown in FIG. 4, the clip 142 defines an innermost rounded portion 145 embracing an enlarged portion 146 on the seal mounting portion 137 for mechanically locking the seal 131 to the wall member 138.

The mounting of seal 132 in the opposite portion of the sealing structure 133 to the door 118 is reversely similar in all respects, as illustrated in FIG. 4.

Sealing means 133 includes an enlarged mounting portion 147 which is retained against the leg 139 of wall 138 by a forward distal end 148 of the mounting clip 142.

The seals 20 and 21 of seal structure 19 include outwardly projecting wiper portions 49 and 50, respectively. In the sealing structure 133, the wiper portions 149 and 150 are deflected against the clip portion 142 to provide an effective seal to the clip at the sides of dead air space 134. Clip portion 148 clamps the seal portions 147 suitably to the wall portion 139 to effect a seal of the sealing structure 133 to the doors, thereby forming the dead air space 127 within the sealing structure 133 corresponding to the dead air space 27 of the seal structure 19.

Thus, sealing structure 119 is substantially similar to sealing structure 19 and is mounted to the french doors 111 and 118 by a suitable mounting clip 142 which further mounts to the doors a third seal structure so as to cooperatively define a pair of vertically extending dead air sealing spaces 127 and 134.

As shown in FIG. 4, the seal structure 119 effectively defines a triple gasket seal in providing the two dead air sealing spaces for providing an improved thermally insulating closure between the french doors of the refrigerated cabinet. The outer dead air space 127 is closed by the overlapping end caps 129 and 130 corresponding to the end caps 29 and 30 of the seal structure 19, as shown in FIG. 3. As discussed above relative to seal structure 19, similar end caps are provided as closure means 28 at the bottom of the dead air space and, thus, the invention comprehends that the outer dead air space 127 be closed at its upper and lower ends by the overlapping closure means 128 defined by the end caps 129 and 130.

The inner dead air space 134 is closed at its upper and lower ends by the top and bottom walls of the refrigerated cabinet, which walls are in close proximity to the top and bottom of the sealing structure 119. Thus, the invention comprehended by seal structure 119 is the provision of two dead air spaces which are effectively closed at the top and bottom ends thereof so as to form a dual thermal insulating closure of the french doors.

INDUSTRIAL APPLICABILITY

The improved end cap means for providing sealed closure of the vertical air space defined by the dual seal gasket structures 20 and 21, respectively, reduces or eliminates condensation on the exterior gasket surfaces, thus eliminating the need for heating devices and the like and providing improved thermal efficiency in the operation of the refrigeration apparatus.

The improved sealing means is adapted for use with a wide range of different refrigeration apparatuses utilizing french-type doors wherein the juxtaposed door portions extend across an opening to the refrigerated space. The invention is adapted for use both where the center mullion is missing or where the center mullion is provided, as the sealing means is effectively provided exteriorly of the cabinet independently of the provision of a center mullion.

The seals may be formed as continuous extrusions and thus facilitated sealing of the doors may be effected. The use of the closure means 28 is permitted by the simple additional step of securing the end caps 29 and 30 in place on the ends of the sealing elements at the top and bottom of the air space 27, as discussed above, and thus, the invention is adapted for use with existing dual seal structures as well as in new manufacture thereof.

In the modified form of FIG. 4, the dual dead air space seal provides a further improved effective thermal barrier between the french doors and, thus, is advantageously adapted for use with refrigeration apparatus, such as home freezers and the like.

The foregoing disclosure of specific embodiments is illustrative of the broad inventive concepts comprehended by the invention.

Having described the invention, the embodiments of the invention in which an exclusive property or privilege is claimed are defined as follows:

1. In a refrigeration apparatus having wall means defining a refrigerated space and having a front portion defining an access opening to said space, a pair of doors pivotally mounted in side-by-side relationship for selectively closing said access opening, and seal elements carried by portions of the doors which are juxtaposed when the doors are positioned to close said access opening outwardly of said wall means, said seal elements including outer portions cooperatively defining an outer seal and inner portions cooperatively defining an inner seal with an air space having upper and lower ends between said outer and inner seals when the doors are positioned to close said outer and inner seals when the doors are positioned to close said access opening, the improvement comprising:

sealing closure means for closing said ends of said air space to define a dead air space between said doors outwardly of said wall means front portion when said doors are positioned to close said access opening.

2. The refrigeration apparatus of claim 1 wherein said means for closing said air space ends comprises closure elements carried by at least one of said doors.

3. The refrigeration apparatus of claim 1 wherein said means for closing said air space ends comprises flaps carried by each of said doors to overlap in the closed position of said doors.

4. The refrigeration apparatus of claim 1 wherein said means for closing said air space ends comprises horizontal flaps secured to each of said doors to overlap in the closed position of said doors.

5. The refrigeration apparatus of claim 1 wherein said means for closing said air space ends comprises closure elements carried by at least one of said doors and being formed of a material similar to the material of which the seal elements are formed.

6. The refrigeration apparatus of claim 1 further including means for defining a second dead air space within the refrigeration space inwardly adjacent said first named dead air space.

7. In a refrigeration apparatus having wall means defining a refrigerated space and an access opening to said space, first and second doors pivotally mounted to said wall means for selectively closing said opening, said doors defining vertically extending edge portions which are juxtaposed when the doors are in a closed position across said opening, a first, outer pair of seals mounted one each to said door edge portions and extending therefrom into sealed engagement with each other when said doors are in said closed position, and a second, inner pair of seals mounted one each to said door edge portions and extending therefrom into sealed engagement with each other inwardly of said first pair of seals when said doors are in said closed position, said first and second pairs of seals defining an air space between said doors exteriorly of said refrigerated space and immediately forwardly of said access opening, the improvement comprising closure means carried by at least one of said doors for closing the top and bottom of said air space when said doors are in said closed position whereby said air space comprises an insulative dead air space closed at the top and bottom thereof.

8. The refrigeration apparatus of claim 7 wherein said closure means comprises a first, upper pair of flaps carried one each by said doors at the top of said air space and a second, lower pair of flaps carried one each by said doors at the bottom of said air space.

9. The refrigeration apparatus of claim 7 wherein said closure means comprises a first, upper pair of flaps carried one each by said doors at the top of said air space and a second, lower pair of flaps carried one each by said doors at the bottom of said air space, said upper flaps being arranged to overlap each other when said doors are in said closed position.

10. The refrigeration apparatus of claim 7 wherein said closure means comprises a first, upper pair of flaps carried one each by said doors at the top of said air space and a second, lower pair of flaps carried one each by said doors at the bottom of said air space, said lower flaps being arranged to overlap each other when said doors are in said closed position.

11. The refrigeration apparatus of claim 7 wherein said closure means comprise overlapping end caps carried by at least one of said seals.

12. The refrigeration apparatus of claim 7 wherein at least one of said pairs of seals comprises overlapping flaps and said closure means comprise overlapping flaps.

13. The refrigeration apparatus of claim 7 wherein said closure means comprise flexible elements.

14. The refrigeration apparatus of claim 7 further including means for defining a second dead air space within the refrigeration space inwardly adjacent said first named dead air space.

15. In a refrigeration apparatus having wall means defining a refrigerated space and having a front flange defining an access opening to said space, a pair of doors pivotally mounted in side-by-side relationship for selectively closing said access opening, and flexible seal flaps carried by the vertically extending edge portions of the doors which are juxtaposed when the doors are positioned to close said access opening, said seal flaps defining upper and lower ends and including an outer pair defining an outer seal and an inner pair defining an inner seal, an air space being formed between said outer and inner seals, the improvement comprising:

closure flaps on the upper and lower ends of said seal flaps and overlapping each other to close the ends of said air space when the doors are in the closed position to thereby define with said seal flaps a dead air insulating space along said juxtaposed door edges.

16. The refrigeration apparatus of claim 15 wherein said closure flaps are fixedly secured to said seal flap ends and are formed of material similar to the material of which the seal flaps are formed.

17. The refrigeration apparatus of claim 15 wherein said closure flaps are formed of flexible material.

18. The refrigeration apparatus of claim 15 further including means for defining a second dead air space within the refrigeration space inwardly adjacent said first named dead air space.

19. The refrigeration apparatus of claim 18 wherein said means defining said second dead air space comprises a further pair of seal flaps spaced inwardly from said first named seal flaps for cooperating with a portion of said first named seal flaps in defining said second dead air space.

20. The refrigeration apparatus of claim 18 wherein said wall means defines a top wall and a bottom wall, said second dead air space extending between said top and bottom walls and being effectively closed thereby.

21. In a refrigeration apparatus having wall means defining a refrigerated space and having a front portion defining an access opening to said space, a pair of doors pivotally mounted in side-by-side relationship for selectively closing said access opening, improved means for sealing the space between said doors when said doors are positioned to close said opening, comprising:

first seal means carried by said doors and including top and bottom sealing closure means, said first seal means cooperatively defining an outer closed dead air space forwardly of said wall means front portion; and second seal means carried by said doors and cooperatively defining with said wall means an inner closed dead air space within said access opening.

22. In a refrigeration apparatus having wall means defining a refrigerated space and having a front portion defining an access opening to said space, a pair of doors pivotally mounted in side-by-side relationship for selectively closing said access opening, improved means for sealing the space between said doors when said doors are positioned to close said opening, comprising:

first seal means carried by said doors and cooperatively defining an outer closed dead air space forwardly of said wall means front portion; and second seal means carried by said doors and cooperatively defining with said wall means an inner closed dead air space within said access opening.

23. The refrigeration apparatus of claims 21 or 22 wherein said seal means includes a common seal member defining the inner portion of the first seal means and outer portion of the second seal means.

24. The refrigeration apparatus of claims 21 or 22 wherein a mounting bracket is secured to each of said doors and secures each of said first and second seal means sealingly thereto.

* * * * *